US005330361A

United States Patent [19]

Brend

[11] Patent Number: 5,330,361

[45] Date of Patent: Jul. 19, 1994

[54] ELECTRICAL PLUG LOCKING DEVICE

[76] Inventor: Gary W. Brend, 3329 Cheviot Dr., Tampa, Fla. 33618

[21] Appl. No.: 109,662

[22] Filed: Aug. 20, 1993

[51] Int. Cl.[5] ..... H01R 13/40

[52] U.S. Cl. ..... 439/134; 439/139; 439/304; 70/57

[58] Field of Search ..... 439/133, 134, 139, 304, 439/892; 70/57, 58, 23, 303 R

[56] References Cited

U.S. PATENT DOCUMENTS

| | | | |
|---|---|---|---|
| 2,733,416 | 1/1956 | Evalt | 439/134 |
| 4,445,738 | 5/1984 | Wiencke | 439/133 |
| 4,566,297 | 1/1986 | Hawley | 70/57 |
| 4,957,446 | 9/1990 | Belsky | 439/134 |
| 5,055,057 | 10/1991 | Boyer | 439/134 |
| 5,169,326 | 12/1992 | Werner | 439/134 |
| 5,171,155 | 12/1992 | Mendoza | 439/134 |

*Primary Examiner*—David L. Pirlot
*Assistant Examiner*—Hien D. Vu
*Attorney, Agent, or Firm*—Herbert W. Larson; James E. Larson

[57] ABSTRACT

A two prong plug locking device having opposed top and bottom hemi-spherical housing elements enclosing an intermediate guide lever and guide plate. A keyed tumbler lock turns the intermediate guide lever. Such guide lever is attached to a flexible cable that moves within a channel in the top and bottom housing. A pair of plug prongs inserted into the bottom housing through multiple apertures are engaged by the cable and locked within the bottom housing. By turning the tumbler lock, the cable is retracted from the plug prongs and the plug is released.

15 Claims, 2 Drawing Sheets

ELECTRICAL PLUG LOCKING DEVICE

BACKGROUND OF THE INVENTION

1. Field of the Invention

This invention relates to an electrical plug locking device. More particularly, it relates to a device for prohibiting unauthorized use of electrical appliances.

2. Description of Prior Art

Electrical plug locking devices of various designs are known in the prior art. U.S. Pat. Nos. 2,733,416, 4,566,297, 5,171,155, and 5,169,326 disclose electrical plug locking devices having a housing with an opening to receive at least one prong of an electrical plug. Each one of these U.S. Patents contains a locking member engaging with at least one inserted prong aperture of an electrical plug. A key or combination lock prohibits the plug from being removed without the proper key or combination. A spring engages or releases the locking member from the inserted prong.

U.S. Pat. No. 4,957,446 discloses a lockout device for electrically operated equipment and devices. The lockout device has a housing for receiving at least two prongs of an electrical plug. An externally accessed passageway in the housing axially aligns with holes in the electrical plug prongs. A latching means extends through the passageway and the holes of the prongs to prohibit the plug from being removed from the lockout device.

Although the prior art discloses electrical plug locking devices that successfully prohibit the unauthorized use of an electrical device, such devices have inherent disadvantages. One such disadvantage is the incorporation of a spring mechanism to facilitate movement of the locking means. Springs wear out over time thereby limiting the useful life of a device containing such an element. Other prior art devices contain complex mechanical structures, increasing manufacturing cost and consumer cost. In U.S. Pat. No. 4,957,446 the latching means is preferably comprised of a flexible strap. The strap is externally accessed and could be easily cut.

There is a need for an improved electrical plug locking device having an internal locking mechanism that is simple in design, thereby keeping manufacture and consumer cost low. The device needs to be durable and resistant to breakage to deter tampering. Finally, the electrical plug locking device needs to be devoid of a locking spring mechanism, but still prevent disengagement of the electrical plug prongs from the locking device.

SUMMARY OF THE INVENTION

I have invented an improved electrical plug locking device. My invention employs a generally spherical housing. The housing has a hemi-spherical top and bottom portion. The bottom portion has a planar bottom surface with apertures configured to allow the prongs of a standard electrical plug to pass through the shell of the housing and into an inner cavity of the sphere. With the prongs of an electrical plug inserted into the locking device, apertures on the plug prongs are axially aligned with a channel on an inner surface of the sphere. A tumbler key lock mounted on the top of the locking device extends and retracts a flexible cable through the inner surface channel in the bottom housing portion and the aligned plug prong apertures. The flexible cable is guided by a guide plate mounted within the inner cavity of the sphere. Once the flexible cable extends through the plug prongs, the key is removed thereby retaining the electrical plug prongs within the locking device and prohibiting unauthorized use of any chosen electrical device or appliance.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
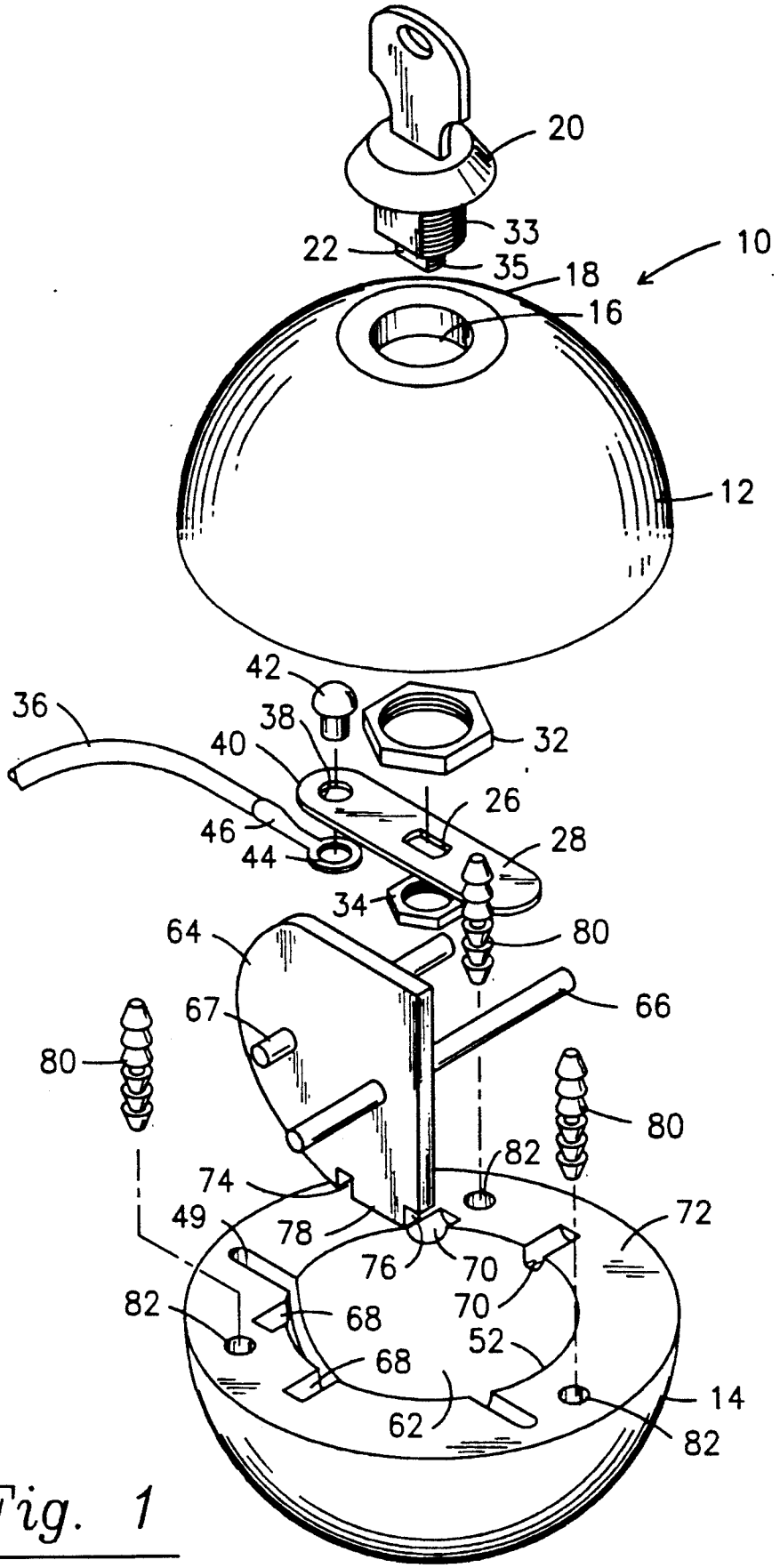
FIG. 1 is an exploded view of the electrical plug locking device.

Throughout the following detailed description, the same reference numerals refer to the same elements in all figures.

Referring to FIG. 1, an electrical plug locking device 10 has a top housing 12 and a bottom housing 14. The locking device 10 is generally spherical whereas the top housing 12 and bottom housing 14 are generally hemispherical.

The top housing 12 has an annular aperture 16 at an apex 18 for insertion of a keyed tumbler lock 20 into the top housing 12. A bottom portion 22 of the tumbler lock 20 is exposed within an inner cavity 24 of the top housing .12. The tumbler lock bottom portion 22 engages with a slot 26 of an intermediate guide lever 28. A first and second locking nut, 32 and 34 respectively, on opposing sides of the guide lever slot 26, secure the tumbler lock 20 to the guide lever 28. Locking nut 32 is secured to threads 33 and locking nut 34 is secured to threads 35. A flexible cable 36 rotatably attaches and axially aligns with an opening 38 at an end portion 40 of the guide lever 28. A rivet 42 is inserted through an eyelet 44 at a first end 46 of the flexible cable 36 and the guide lever end portion opening 38. The flexible cable 36 is inserted into a channel 48 located along top housing 12 inner wall 50 and a contiguous channel 49 located along bottom housing 14 inner wall 52.

The bottom housing 14 has at least two apertures 54 located along a planar bottom surface 56 of the bottom housing 14. The apertures 54 are configured to allow insertion of a standard electrical plug prong 58 through the bottom housing 14 thereby exposing a distal end 60 of the electrical plug prong 58 within an inner cavity 62 in the bottom housing 14. A guide plate 64 is mounted within the bottom housing inner cavity 62 to assist the movement of the flexible cable 36 through channels 48 and 49. A first and second notch, 74 and 76 respectively, are located along a bottom side 78 of the guide plate 64 to receive and align the distal end 60 of the prong 58. Supporting dowels, 66 and 67 respectively, intersecting the guide plate 64, support the guide plate 64 within the bottom housing inner cavity 62. A first and second slot, 68 and 70 respectively, located along a planar top surface 72 of the bottom housing 14, receive and retain supporting dowels 66 and 67 at opposing ends.

As shown in FIG. 1, a plurality of barbed dowels 80, axially mounted within bores 82 on the planar top surface 72 of the bottom housing 14 and a planar bottom surface 84 of the top housing 12, attach the bottom housing 14 and top housing 12 together.

Figure 2:
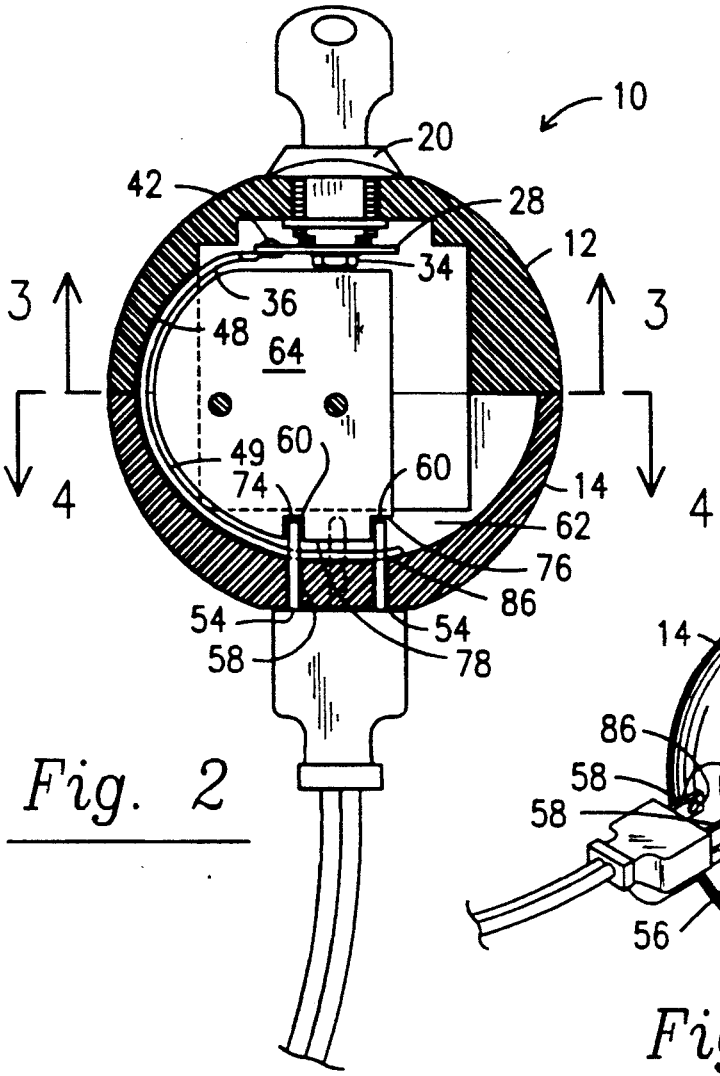
FIG. 2 is a cross sectional elevational view.
Figure 5:
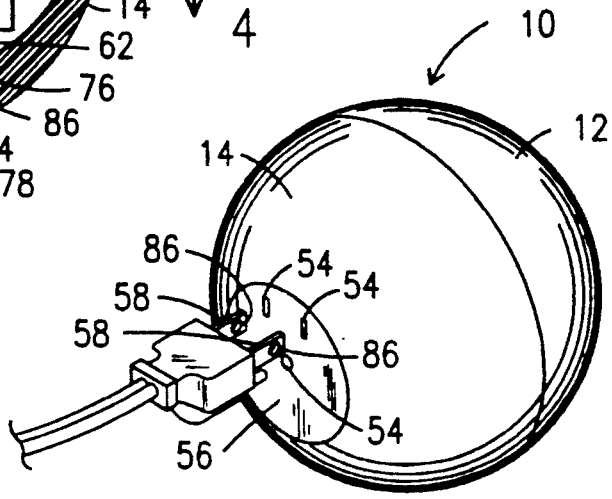
FIG. 5 is a perspective view of the device with an electrical plug being inserted.
Figure 3:
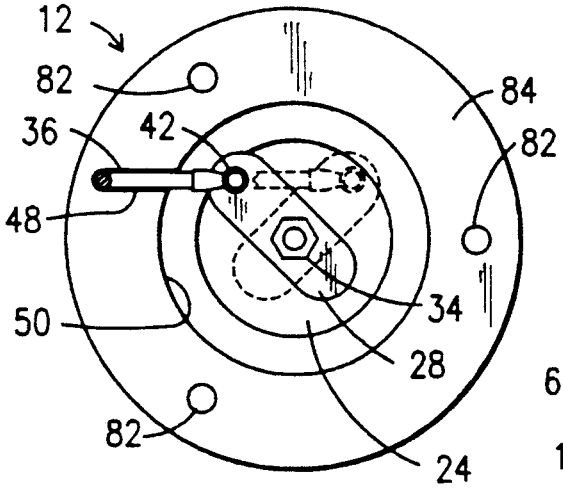
FIG. 3 is a bottom plan view of a top housing.
Figure 4:
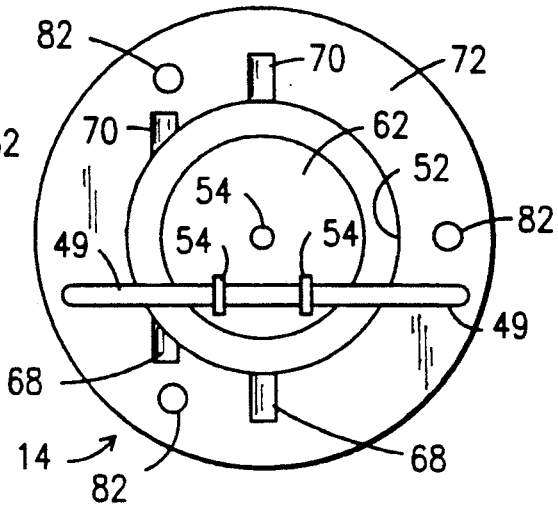
FIG. 4 is a top plan view of a bottom housing.

As shown in FIG. 2, the electrical plug prongs 58 are inserted through the apertures 54 along the planar bottom surface 56 axially aligning prong holes 86, located at the distal end 60 of the flat bladed prongs 58, with contiguous channel 49. When the tumbler lock 20 is actuated, the intermediate guide lever 28 rotates causing the flexible cable 36 to move in channels 48 and 49 and through the prong holes 86. The device 10 has now locked the prongs 58 within housing 14. To remove the prongs 58 from housing 14, the tumbler lock 20 is actuated in a reciprocal direction, causing the flexible cable 36 to recede from the prong holes 86 thereby releasing the prongs 58.

The top and bottom housings, 12 and 14, are manufactured of an opaque high impact plastic. The guide lever, guide plate, supporting dowels, and barbed dowels are manufactured of either steel or a high impact plastic. The flexible cable is made of nylon, polypropylene, or steel wire coated with a poller such as polypropylene.

Equivalent elements can be substituted for the elements employed in this invention to obtain the same results in the same manner.

Having thus described the invention what is claimed and desired to be secured by Letters Patent is:

1. A locking device for use with an electrical plug having two or more prongs, the locking device comprising, a top housing generally hemi-spherical in shape having an inner cavity and an aperture at an apex for insertion of a keyed tumbler lock element, a bottom housing generally hemi-spherical in shape having an inner cavity and a planar bottom surface containing at least two apertures for insertion of prongs from an electrical plug, the tumbler lock element having a bottom portion engaging a slot in an intermediate guide lever mounted in the top housing inner cavity, a locking element mounted on each side of the slot in the intermediate guide lever to secure the tumbler loch to the intermediate guide lever, a flexible cable rotatably attached at an end of the intermediate guide lever and inserted into a channel of inner walls of the top and bottom housings, a guide plate mounted in the inner wall of the bottom housing to assist movement of the flexible cable, a first and second notches on bottom portion of the guide plate to receive and align a tip of the electrical plug prong and, a plurality of attaching elements axially mounted within bores on a planar top surface of the bottom housing and a planar bottom surface of the top housing to attach the top and bottom housing together.

2. A locking device for use with an electrical plug having two or more prongs according to claim 1 wherein, the locking element mounted on each side of the guide lever slot is a pair of locking nuts.

3. A locking device for use with an electrical plug having two or more prongs according to claim 1 wherein, the flexible cable it is rotatably attached by a rivet intersecting an eyelet on a first end of the flexible cable and an opening of an end of the guide lever.

4. A locking device for use with an electrical plug having two or more prongs according to claim 1 wherein, at least one supporting dowel intersects the guide plate to support the guide plate mounted within an inner cavity of the bottom housing.

5. A locking device for use with an electrical plug having two or more prongs according to claim 4 wherein, the supporting dowel intersects the guide plate at a ninety degree angle.

6. A locking device for use with an electrical plug having two or more prongs according to claim 4 wherein, a first and second slots on a planar top surface of the bottom housing receives and retains ends of the supporting dowel.

7. A locking device for use with an electrical plug having two or more prongs according to claim 1 wherein, the plurality of attaching elements are barbed dowels.

8. A locking device for use with an electrical plug having two or more prongs, the locking device comprising, a top housing generally hemi-spherical in shape having an inner cavity and an aperture at an apex for insertion of a keyed tumbler lock element, a bottom housing generally hemi-spherical in shape having an inner cavity and a planar bottom surface containing at least two apertures for insertion of prongs from an electrical plug, the tumbler lock element having a bottom portion engaging a slot in an intermediate guide lever mounted in the top housing inner cavity, a pair of locking nuts on each side of the guide lever slot to secure the tumbler lock to the intermediate guide lever, a flexible cable rotatably attached at an end of the intermediate guide lever and inserted into a channel of inner walls of the top and bottom housings, a guide plate mounted the inner wall of the bottom housing to assist the movement of the flexible cable, a first and second notches on bottom portion of the guide plate to receive and align a tip of the electrical plug prong and, a plurality of barbed dowels axially mounted within bores on a planar top surface of the bottom housing and a planar bottom surface of the top housing to attach the top and bottom housing together.

9. A locking device for use with an electrical plug having two or more prongs according to claim 8 wherein, the flexible cable is rotatably attached by a rivet intersecting an eyelet on a first end of the flexible cable and an opening on the end of the guide lever.

10. A locking device for use with an electrical plug having two or more prongs according to claim 8 wherein, at least one supporting dowel intersects the guide plate to support the guide plate mounted within the bottom housing inner cavity.

11. A locking device for use with an electrical plug having two or more prongs according to claim 10 wherein, the supporting dowel intersects the guide plate at a ninety degree angle.

12. A locking device for use with an electrical plug having two or more prongs according to claim 10 wherein, a first and second slot on a planar top surface of the bottom housing receives and retains the supporting dowel at opposing ends.

13. A locking device for use with an electrical plug having two or more prongs, the locking device comprising, a top housing generally hemi-spherical in shape having an inner cavity and an aperture at an apex for insertion of a keyed tumbler lock element, a bottom housing generally hemi-spherical in shape having an inner cavity and a planar bottom surface containing at least two apertures for insertion of prongs from an electrical plug, the tumbler lock element having a bottom portion engaging a slot in an intermediate guide lever mounted in the top housing inner cavity, a pair of locking nuts on each side of the guide lever slot engaging threads on a bottom portion of the tumbler locking element to secure the tumbler lock to the intermediate guide lever, a flexible cable rotatably attached at an end of the intermediate guide lever and inserted into a channel of inner walls of the top and bottom housings, a rivet intersecting an eyelet on a first end of the flexible cable and an opening on the end of the guide lever, a guide plate mounted in the inner wall of the bottom housing to assist movement of the flexible cable, at least one supporting dowel intersecting the guide plate at a ninety degree angle to support the guide plate mounted within an inner cavity of the bottom housing, first and second slot on a planar top surface of the bottom housing to receive and retain the supporting dowel at opposing ends, a first and second notch on a bottom portion of the guide plate to receive and align a tip of the electrical plug prong and, a plurality of barbed dowels axially mounted within bores on a planar top surface of the bottom housing and a planar bottom surface of the top housing to attach the top and bottom housing together.

14. A locking device for use with an electrical plug having two or more prongs according to claim 13 wherein, two supporting dowels intersect the guide plate.

15. A locking device for use with an electrical plug having two or more prongs according to claim 13 wherein, three barbed dowels attach the top and bottom housing.

* * * * *